US008517466B1

(12) United States Patent
Wizorek et al.

(10) Patent No.: US 8,517,466 B1
(45) Date of Patent: Aug. 27, 2013

(54) CONVERTIBLE BOAT SEAT

(75) Inventors: John O. Wizorek, Fremont, IN (US); Don Mason, Fort Wayne, IN (US); Bob Fieldhouse, Fort Wayne, IN (US)

(73) Assignee: Brunswick Corporation, Lake Forest, IL (US)

( * ) Notice: Subject to any disclaimer, the term of this patent is extended or adjusted under 35 U.S.C. 154(b) by 217 days.

(21) Appl. No.: 13/177,825

(22) Filed: Jul. 7, 2011

(51) Int. Cl.
*A47C 15/00* (2006.01)

(52) U.S. Cl.
USPC ..... 297/232; 297/353; 297/411.36; 297/115; 297/118

(58) Field of Classification Search
USPC ..... 297/115, 118, 217.4, 283.1, 284.3, 297/313, 353, 411.32, 411.36, 112, 113, 297/284.11, 232, 257
See application file for complete search history.

(56) References Cited

U.S. PATENT DOCUMENTS

| | | | | | |
|---|---|---|---|---|---|
| 244,330 | A | | 7/1881 | Snyder | |
| 534,734 | A | * | 2/1895 | Wilson | 297/353 |
| 2,069,604 | A | | 2/1937 | Elliman | |
| 2,334,934 | A | * | 11/1943 | Karsakov et al. | 5/47 |
| 2,348,407 | A | * | 5/1944 | O'Neill | 297/67 |
| 3,196,324 | A | * | 7/1965 | Staetzer | 361/500 |
| 3,215,468 | A | * | 11/1965 | Swenson et al. | 297/284.1 |
| 3,379,417 | A | | 4/1968 | Dalziel | |
| 3,394,417 | A | * | 7/1968 | O'Link | 114/363 |
| 3,473,176 | A | * | 10/1969 | Taylor | 114/363 |
| 3,596,981 | A | * | 8/1971 | Koziol | 297/154 |
| 3,668,719 | A | * | 6/1972 | Romero | 5/17 |
| 3,910,630 | A | * | 10/1975 | Runyon et al. | 297/63 |
| 3,945,651 | A | * | 3/1976 | Boswinkel | 297/337 |
| 4,132,447 | A | * | 1/1979 | Terada | 297/367 R |
| 4,268,086 | A | * | 5/1981 | Okuyama | 297/63 |
| 4,297,752 | A | | 11/1981 | Dick et al. | |
| 4,490,842 | A | * | 12/1984 | Watanabe | 381/86 |
| 5,597,203 | A | * | 1/1997 | Hubbard | 297/284.3 |
| 5,628,547 | A | * | 5/1997 | Matsumiya | 297/354.11 |
| 5,718,479 | A | * | 2/1998 | Rautenbach | 297/354.13 |
| 5,799,605 | A | * | 9/1998 | Huse | 114/363 |
| 6,257,667 | B1 | * | 7/2001 | Boren et al. | 297/353 |
| 6,520,586 | B2 | | 2/2003 | Park | |
| 6,655,731 | B2 | * | 12/2003 | Martin | 297/23 |
| 6,672,667 | B1 | * | 1/2004 | Park | 297/344.1 |
| 7,134,727 | B2 | | 11/2006 | Willilams | |
| 7,318,622 | B2 | | 1/2008 | Rezag et al. | |
| 7,513,211 | B1 | * | 4/2009 | Farb et al. | 114/363 |
| 7,517,010 | B2 | | 4/2009 | Saint-James et al. | |
| 7,648,197 | B1 | | 1/2010 | Delmestri | |
| 2008/0012414 | A1 | * | 1/2008 | Dewert | 297/354.11 |
| 2009/0295202 | A1 | * | 12/2009 | Takada et al. | 297/217.4 |
| 2010/0154685 | A1 | * | 6/2010 | Arinstein | 108/57.16 |

* cited by examiner

*Primary Examiner* — David Dunn
*Assistant Examiner* — Alexander Harrison
(74) *Attorney, Agent, or Firm* — Malin Haley DiMaggio & Bowen, P.A.

(57) ABSTRACT

A convertible boat seat transforms from a standard bench-style seat configuration capable of accommodating multiple occupants to a lounger that allows a single occupant to comfortably lounge without impeding into the available deck space. A convertible boat seat comprises a chaise lounge type seat having a plurality of configurable components including a two-piece back rest, a configurable armrest, a hinging bench seat assembly, and an inclined chaise end forming a lounge backrest adapted with a pivoting armrest. The two-piece backrest includes first and second backrest components that are each configurable between a raised position and a lowered position. The inclined chaise end includes a pivoting armrest configurable between a stowed, out-of-the-way position, and a deployed position wherein it functions as a lounge armrest. A hinging bench seat includes first and second hingedly connected seat components that are configurable between a generally flat configuration for bench seating and a raised configuration wherein the lounger's knees are supported in a partially bent lounging position. On an opposing end of the inclined chaise end is an armrest configurable between a raised position wherein it functions as an armrest when the seat is configured for bench-style seating, and a lowered position wherein it is stowed generally flush with the bench seat surface for providing increased leg room while lounging.

7 Claims, 4 Drawing Sheets

CONVERTIBLE BOAT SEAT

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to a seating apparatus and, more particularly, to a marine seating apparatus that is convertible between a bench-type seat configuration and a lounge-type seat configuration.

2. Description of Related Art

Trends in the recreational boating industry include an emphasis on more family oriented pleasure craft designs. As a result of these trends, pontoon boats have experienced increased popularity. A pontoon boat is a small pleasure craft having a deck supported by two or three pontoons mounted lengthwise. Among the advantages of pontoon boats are their stability, ownership economics, maximized deck space, and versatile deck configurations. Pontoon boats have become a popular choice for those wishing to carry multiple people for entertaining, lounging, and enjoying the outdoors.

As with all recreational boats, however, pontoon boats have a limited amount of deck space in which to accommodate seating. Accordingly, the challenge facing boat designers is to make efficient use of the space available so as to maximize both seating occupancy as well as comfort. The competing demands associated with entertaining verses lounging activities have presented significant challenges to marine vessel designers. For example, when entertaining a seating configuration that maximizes seating occupancy at the bow and stern, while maintaining ample floor space such that occupants can move freely about the boat, is desired. When lounging, however, lounge seating configurations, which allow fewer occupants to lounge in positions facing forward (bow) or rearward (stern), are desired. Conventional seating arrangements for recreational boats, and particularly pontoon boats, have failed to adequately provide seating options to satisfy these competing demands.

The background art reveals a number of attempts to provide convertible seating in a variety of environments. U.S. Pat. No. 244,330, issued to Snyder in 1881, discloses a lounge having a back that can be raised up and folded over to form a bed without disturbing the position of any other portion of the lounger. U.S. Pat. No. 2,069,604, issued to Elliman, discloses an article of furniture which is convertible from a couch or sofa configuration with a back rest, to a bed by pivotal downward movement of the back rest. U.S. Pat. No. 3,379,471, issued to Dalziel, discloses converting oppositely facing chairs into a lounge. One significant problem with the apparatus disclosed by Dalziel, however, is that it is not suitable for use with pontoon boats due to the requirement for oppositely facing chairs. U.S. Pat. No. 4,297,752, issued to Dick et al., discloses a convertible article of furniture presenting a loveseat or couch in on arrangement and a day bed in the other by movement of the back rest and an arm rest. U.S. Pat. No. 6,520,586, issued to Park, discloses a seating structure equipped with a retractable armrest movable between a first position, in which the armrest is positioned on a lateral side of the seat in an upright manner, and a second position, in which the armrest is positioned in a space below the seat. U.S. Pat. No. 7,134,727, issued to Williams, discloses a sofa having an arm assembly that may be converted to a back rest to allow a person to sit crosswise, and a lower front panel that may be configured to act as an armrest for a person sitting crosswise. One disadvantage present with the sofa disclosed by Williams, however, is that when configured as a lounge, the remaining portion of the sofa backrest is high and thus significantly limits visibility when sitting in the lounging position.

The convertible seating disclosures of the background art fail to adequately address the need in the art pontoon boat seating. Accordingly, there exists a need for a pontoon boat seat that is convertible from a standard bench-style configuration capable of accommodating multiple occupants to a lounger that allows a single occupant to comfortably lounge without impeding into the available deck space.

BRIEF SUMMARY OF THE INVENTION

The present invention overcomes the limitations and disadvantages in the art by providing a convertible pontoon boat seat that is convertible from a standard bench-style seat configuration capable of accommodating multiple occupants to a lounger that allows a single occupant to comfortably lounge without impeding into the available deck space.

A convertible boat seat in accordance with the present invention generally comprises a chaise lounge type seat having a plurality of articulatingly configurable components including an inclined chaise end forming a lounge backrest adapted with a pivoting armrest, a two-piece back rest, a stowable armrest, a hinging bench seat assembly. The two-piece backrest includes a first backrest component positioned generally adjacent to the chaise end which is configurable between an extended position wherein it is raised to function as a conventional bench seat backrest, and a retracted position wherein it is partially lowered to enable the top thereof to function as a lounge seat armrest. The inclined chaise end includes a pivoting armrest configurable between a stowed position (i.e. out-of-the-way), and a deployed position wherein it functions as a lounge armrest. As used herein the term "stowed" shall broadly refer to an alternate position wherein the subject structure is moved relative to its deployed position, and shall not be construed to require that the subject structure be hidden from sight, or recessed partially or totally within a housing or other structure. A hinging bench seat includes first and second hingedly connected seat components that are configurable between a generally flat configuration for bench seating and a raised configuration wherein the lounger's knees are supported in a partially bent lounging position. On an opposing end of the inclined chaise end is an armrest configurable between an extended position wherein it is suitably raised such that the top thereof functions as an armrest when the seat is configured for bench-style seating, and a lowered position wherein it is stowed generally flush with the bench seat surface for providing increased leg room while lounging. The second backrest component is configurable between a raised position wherein it functions as a conventional bench seat backrest, and a fully lowered position wherein it is recessed within the seat structure and out of the way thereby providing an open space for lounging and viewing.

In a first or bench-seat configuration, the convertible boat seat is configured as a bench-style seat capable of accommodating multiple occupants. In this configuration, the first and second back rest components are articulated in the raised positions, the hingedly connected seat components are articulated to the generally flat configuration, the pivoting armrest is articulated to its stowed configuration, and the opposing end armrest is articulated in the raised position wherein it functions as an armrest.

In a second or lounge-seat configuration, the convertible boat seat is configured for reclined or lounge seating wherein the user's back rests on the inclined chaise end with legs generally outstretched. In this configuration, the pivoting armrest is articulated to the deployed position wherein it functions as a lounge armrest, the first backrest component is disposed in the partially lowered position wherein it functions as a lounge seat armrest, the second backrest component disposed to its fully lowered position wherein it is recessed generally flush with the seat structure thereby providing an open space for lounging and viewing, the first and second hingedly connected bench seat components are articulated to the raised configuration forming an arch-shaped surface capable of supporting the occupant's knees in a partially bent lounging position, and the opposing end armrest is articulated to the lowered position wherein it is stowed generally flush with the bench seat surface for providing increased leg room.

Accordingly, it is an object of the present invention to provide advancements in the field of seating and deck design for recreational boats.

Still another object of the present invention is to provide improved pleasure craft seating in the form of a convertible boat seat which is transformable between a bench-type seat configuration and a lounge-type seat configuration.

Yet another object of the present invention is to provide advancements in pontoon boat seating comprising a chaise lounge type seat having a plurality of configurable components including a two-piece back rest, a configurable armrest, a hinging bench seat assembly, and an inclined chaise end forming a lounge backrest adapted with a pivoting armrest.

These and other objects are met by the present invention which will become more apparent from the accompanying drawing and the following detailed description of the drawings and preferred embodiments.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
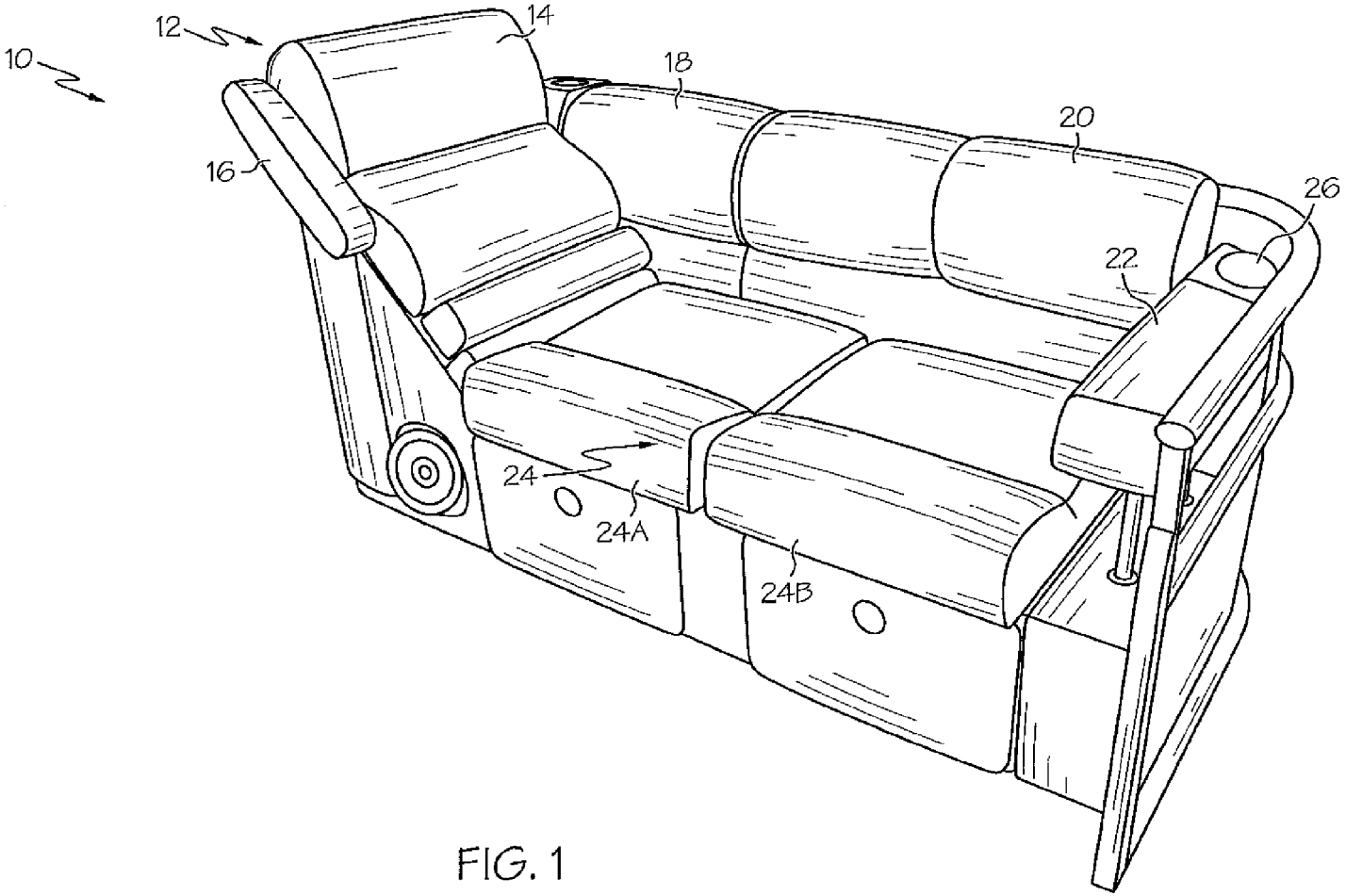
FIG. 1 is a front perspective view illustrating a convertible boat seat in accordance with the present invention configured as a conventional bench seat.
Figure 2:
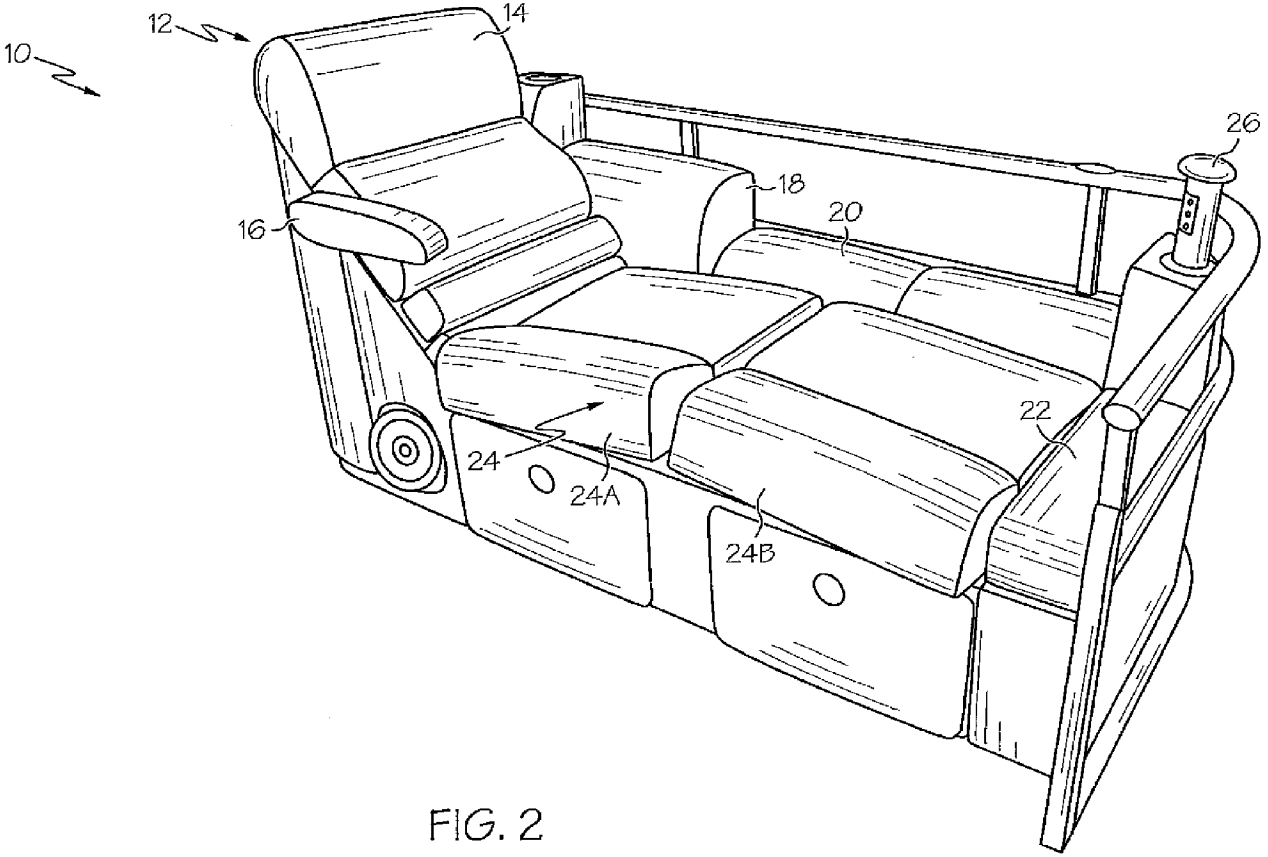
FIG. 2 is a front perspective view illustrating the convertible boat seat configured for lounge seating.

Turning now to the drawings, FIGS. 1-4 depict a convertible boat seat, generally referenced as 10, in accordance with the present invention. Convertible boat seat 10 comprises a seating apparatus which is transformable between a standard bench-style seat configuration, as illustrated in FIG. 1, capable of accommodating multiple occupants, to a lounge-style seat configuration, as illustrated in FIG. 2, that allows a single occupant to comfortably lounge without impeding into the available deck space by articulation of seat components.

Convertible boat seat 10 generally comprises a seating assembly having a plurality of configurable components including: (a) a first end assembly forming a chaise lounge end, generally referenced as 12, including an inclined lounge backrest 14 and a pivoting armrest 16; (b) a backrest assembly including a two-piece backrest having first and second back rest components, referenced as 18 and 20 respectively; (c) a second end assembly including a stowable armrest 22; and (d) seating surface assembly including a two-piece hinging seat surface assembly, generally referenced as 24, and including first and second bench seat components, referenced as 24A and 24B respectively; as well as a stowable and deployable speaker 26.

Chaise lounge end 12 includes a fixed inclined backrest 14, which is disposed in facing relation with an opposing end of boat seat 10 so as to provide a backrest for an occupant seated in a lounging position. Inclined backrest 14 is preferably fixedly disposed at a suitable angle to function as a backrest for a person sitting in a lounging seating position. Chaise end 12 further includes a pivoting armrest 16 configurable between a stowed position, as seen in FIG. 1, and a deployed position, wherein armrest 26 functions as a lounge armrest as seen in FIG. 2. In an alternate embodiment, pivoting armrest 16 may be configured to a stowed configuration wherein it is moved into flush engagement with the backrest 14, such as within a recess (not shown) formed in the side of backrest 14 so as not to protrude from chaise end 12 (e.g. to generally conform to the overall backrest structure).

First backrest component 18 is positioned generally adjacent to the chaise end 12 and functions as a combination component, namely a backrest in a first configuration and an armrest in a second configuration. More particularly, first backrest component 18 is configurable between a raised or extended position wherein it is disposed at a suitable height to function as a conventional bench seat backrest as shown in FIG. 1, and a partially lowered or retracted position wherein the top thereof is disposed at a suitable height to function as a lounge seat armrest as shown in FIG. 2. Movement of backrest component 18 is preferably accomplished by a plurality of stainless steel sliders, and component 18 is preferably supported in the raised position by a locking gas cylinder (not shown). A release mechanism is provided to allow the user to actuate the locking gas cylinder to facilitate configuring component 18. In a preferred embodiment, the release mechanism is located at the top of component 18, and functions to activate the locking cylinder via a pivoting link that applies pressure to a release button on the gas cylinder.

Second backrest component 20 is disposed substantially adjacent to first backrest component 18 and functions as a combination component, namely a backrest in a first configuration and a seat extension in a second configuration. More particularly, second backrest component 20 is configurable between a raised or extended position wherein it functions as a conventional backrest as best seen in FIG. 1, and a fully lowered or retracted position wherein it is substantially flush or even with the bench seat structure 24 thereby providing an open space for lounging and viewing as best seen in FIG. 2. Movement of backrest component 20 is preferably accomplished by a plurality of stainless steel sliders, and component 20 is preferably supported in the raised position by a locking gas cylinder (not shown). A release mechanism is provided to allow the user to actuate the locking gas cylinder to facilitate configuring component 20. In a preferred embodiment, the release mechanism is located at the top of component 20, and functions to activate the locking cylinder via a pivoting link that applies pressure to a release button on the gas cylinder.

The seating surface assembly, generally referenced as 24, includes first and second hingedly connected seat components, referenced as 24A and 248 respectively. Hingedly connected seat components 24A and 24B are preferably connected by stainless steel hinges. An actuator (not shown) functions to convert seat 24 between a generally flat configuration suitable for bench seating as illustrated in FIG. 1, and a raised configuration wherein components 24A and 24B from an arched or shallow A-frame structure such that the lounger's knees are supported in a partially bent lounging position as illustrated in FIG. 2. The actuator is preferably actuated by a small handle that is incorporated into the assembly.

The second end assembly includes an armrest 22, located on an opposing end from the inclined chaise end 12, which is configurable between a raised position wherein it functions as an armrest when the seat is configured for bench-style seating as seen in FIG. 1, and a lowered position wherein it is stowed generally flush with the bench seat surface for providing increased leg room while lounging as seen in FIG. 2. Movement of armrest 22 is facilitated by a plurality of stainless steel rods sliding through plastic bearings having an engineered thickness to provide adequate support, bearing area, and stiffness to the assembly. Armrest 22 is preferably maintained in the raised position by a stainless steel latch.

As noted above speaker 26 is configurable between a stowed configuration wherein it is generally recessed within a structural portion of the boat seat when not in use, and a deployed configuration wherein the speaker is raised in pop-up fashion when in use. In addition, speaker 26 is preferably rotatable about a generally vertical axis to allow the speaker to be positioned to face in any suitable direction to maximize sound quality. In a preferred embodiment, speaker 26 is capable of 180-degrees of rotation, however, in an alternate embodiment speaker 26 may be configured for full 360-degree rotation.

FIG. 1 depicts boat seat 10 disposed in a first or bench-style seat configuration wherein the seat accommodates multiple occupants. In this configuration, pivoting armrest 16 is positioned in alignment with the edge of inclined lounge backrest 14 so as to be generally out-of-the-way. The first backrest component 18, which is located generally adjacent to the chaise end 12 of boat seat 10, is configured in the extended position wherein it functions as a conventional bench seat backrest structure. Likewise, the second backrest component 20, which is located adjacent to first backrest component 18, is configured in the extended position for providing a conventional backrest structure. Stowable armrest 22 is preferably disposed in the extended configuration wherein the top thereof provides a properly positioned arm rest surface. Further, the bench seat assembly 24 is configured with bench seat components 24A and 24B disposed so as to form a generally horizontal planar seating surface. Finally, speaker 26 may be disposed in either the stowed position, as shown in FIG. 1, or a deployed position, as shown in FIG. 2.

FIG. 2 depicts boat seat 10 disposed in a second or lounge-seat configuration that allows a single occupant to comfortably lounge without impeding into the available deck space. In this configuration, the inclined lounge backrest 14, at the chaise end 12, functions as a reclined backrest for the occupant, with arm rest 16 pivoted to the generally horizontal configuration for providing a properly positioned arm rest surface. The first backrest component 18 is disposed in the partially lowered position wherein it functions as a lounge seat armrest, and the second backrest component 20 is configured to a fully lowered or stowed position wherein it is recessed within the seat structure and out of the way thereby providing an open space for lounging and viewing. Armrest 22 is configured in the lowered or stowed configuration providing an open space for lounging and viewing. Further, the bench seat assembly 24 is configured with bench seat components 24A and 24B articulated to the raised configuration forming a shallow A-frame surface such that the lounger's knees may be supported in a partially bent lounging position.

Figure 3:
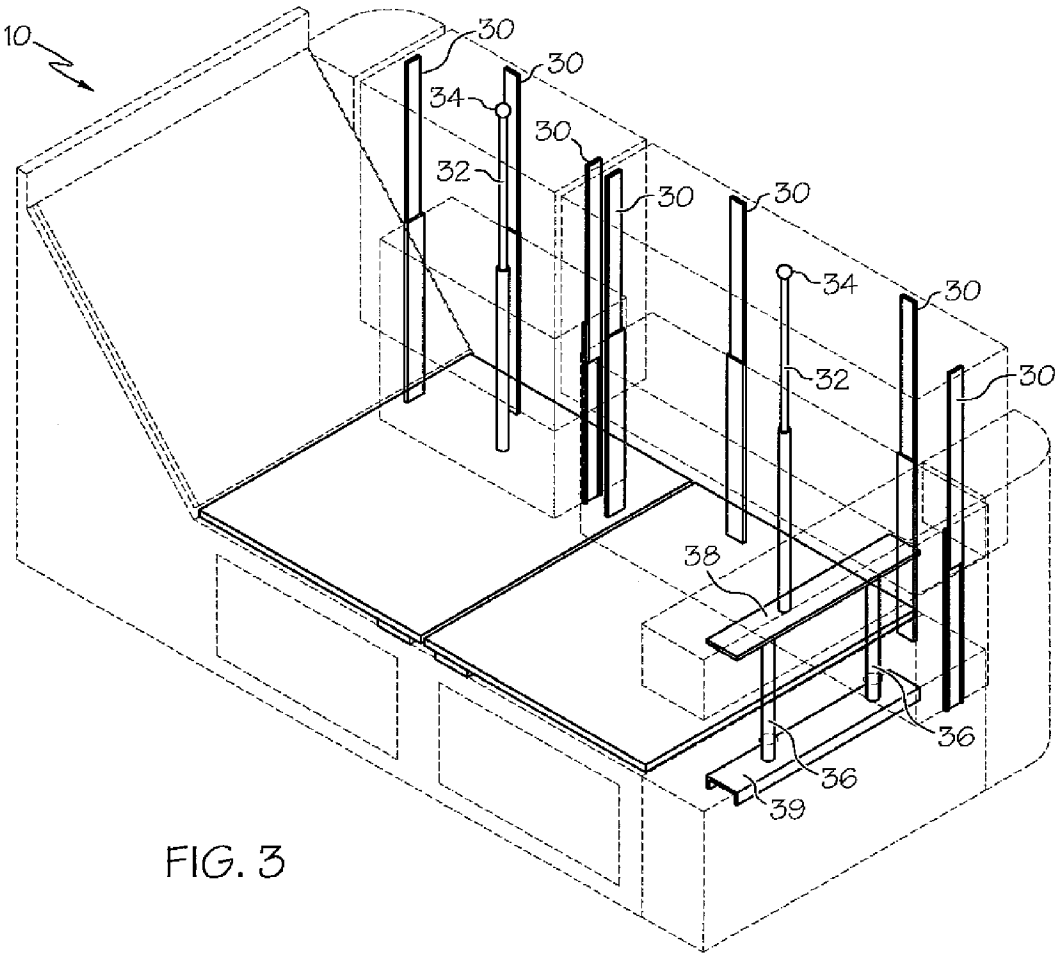
FIG. 3 is front perspective view that provides a schematic illustration of sliders and gas actuator components for the convertible boat seat configured as a conventional bench seat.
Figure 4:
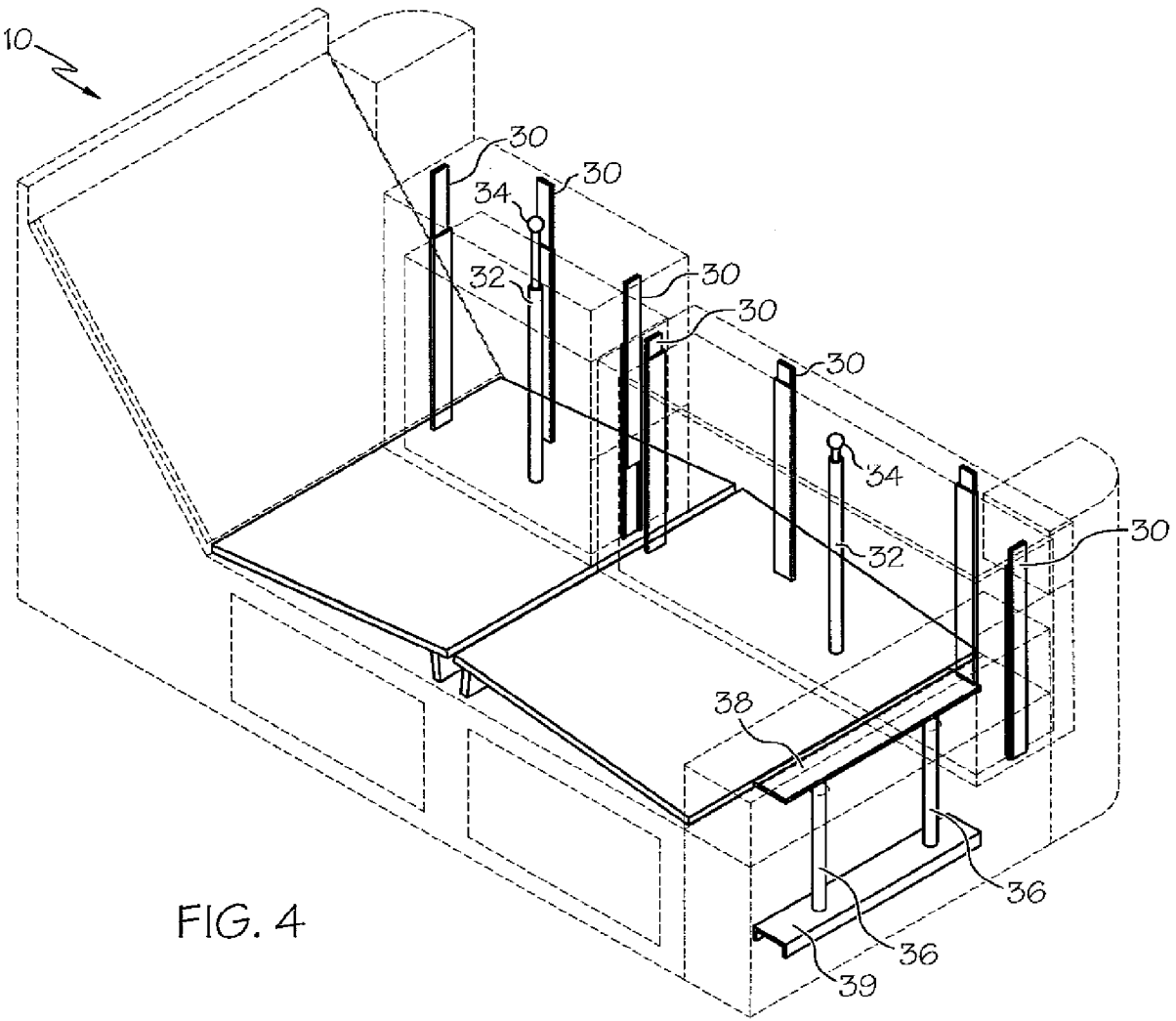
FIG. 4 is a front perspective view that provides a schematic illustration of sliders and gas actuator components for the convertible boat seat configured for lounge seating.

FIGS. 3 and 4 provide schematic illustrations depicting internal mechanical components associated with converting boat seat 10 comprises between the bench-style seat configuration illustrated in FIG. 3, and the lounge-style seat configuration illustrated in FIG. 4. More particularly, boat seat 10 includes a plurality of telescopically adjustable slider members, generally referenced as 30, installed in connection with the first and second back rest components 18 and 20. Slider members 30 are preferably telescopically adjustable stainless steel sliding components capable of guiding the components between the raised and lowered configurations shown in FIGS. 3 and 4. In addition, extendable and retractable locking gas cylinders, generally referenced as 32, are provided to urge the first and second back rest components 18 and 20 to the raised positions illustrated in FIG. 4. Locking gas cylinders 32 rely on compressed gas to selectively allow for configuration of the cylinder 32 from a retracted configuration, as depicted in FIG. 3, to an extended configuration as depicted in FIG. 4, as well as to any desired position between the fully extended and retracted configurations. Each gas cylinder further includes an actuator 34 which is preferably disposed on the upper end thereof, such as the top of the backrest (so as to be within reach of the user). Actuator 34 functions to actuate the gas cylinder for adjustment. Accordingly, by selective actuation of actuator 34 the user is capable of configuring the back rest components to the extended configuration and/or optionally to the retracted configuration or any desired position in between. Actuator comprises a release assembly that is preferably disposed at the top of the backrest and includes a pivoting link that applies pressure to the release button on the air cylinder.

FIGS. 3 and 4 further illustrate internal support and actuation structure for armrest 22. More particularly, movement of armrest 22 is facilitated by a plurality of stainless steel rods 36 that preferably slide through plastic bearings having an engineered thickness to provide adequate support, bearing area, and stiffness to the assembly. The armrest support structure further includes a top plate 38 and a bottom plate 39 connected to the top and bottom ends or rods 36 as best seen in FIGS. 3 and 4. Armrest 22 is preferably maintained in the raised position by a stainless steel latch.

FIGS. 3 and 4 further illustrate movement of the hinging bench seat 24, and particularly first and second hingedly connected seat components 24A and 24B. Hingedly connected seat components 24A and 24B are preferably connected to the boat seat structure by stainless steel hinges. An actuator (not shown) functions to convert seat 24 between a generally flat configuration suitable for bench seating as illustrated in FIG. 1, and a raised configuration wherein components 24A and 24B from an arched or shallow A-frame structure such that the lounger's knees are supported in a partially bent lounging position as illustrated in FIG. 2. The actuator is preferably actuated by a small handle that is incorporated into the assembly.

Therefore, the foregoing is considered as illustrative only of the principles of the invention. Further, since numerous modifications and changes will readily occur to those skilled in the art it is not desired to limit the invention to the exact construction and operation shown and described, and accordingly, all suitable modifications and equivalents may be resorted to, falling within the scope of the invention.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A convertible boat seat configurable between a bench-style seat configuration and a lounge-style seat configuration, said convertible boat seat comprising:

a seating apparatus, including a seating surface assembly, a backrest assembly, and opposing first and second end assemblies;

said first end assembly including an inclined backrest projecting upward from said seating surface assembly, and an armrest, pivotally connected to said first end assembly, said armrest configurable between a stowed position and a deployed position;

said backrest assembly including a first and second backrest components, said second backrest component substantially adjacent to said first backrest component;

said first backrest component configurable between a raised position wherein said first backrest component functions as a conventional backrest, and a retracted lowered position wherein the top of said first backrest component functions as a lounge seat armrest;

said second backrest component configurable between a raised position wherein said second backrest component functions as a conventional backrest, and a retracted lowered position wherein said second backrest component is substantially flush with said seating surface; and said second end assembly including an armrest configurable between a raised position wherein the top thereof is disposed to function as an armrest, and lowered position wherein the top thereof is disposed generally flush said seating surface.

2. A convertible boat seat according to claim 1, wherein said seating surface assembly includes first and second hingedly connected seat components configurable between a generally flat configuration suitable for bench seating, and a raised configuration wherein said first and second hingedly connected seat components hinge upward to form an arched A-frame structure for supporting the occupants knees in a partially bent lounging position.

3. A convertible boat seat according to claim 1, further including a speaker configurable between a stowed configuration wherein said speaker is generally recessed and a deployed configuration wherein said speaker projects from said boat seat.

4. A convertible boat seat according to claim 3, wherein said speaker is rotatable 360-degrees about a generally vertical axis when in said deployed configuration.

5. A convertible boat seat configurable between a bench-style seat configuration and a lounge-style seat configuration, said convertible boat seat comprising:

a seating apparatus, including a seating surface assembly, a backrest assembly, and opposing first and second end assemblies;

said first end assembly including an inclined backrest projecting upward from said seating surface assembly, and an armrest pivotally connected to said first end assembly, said armrest configurable between stowed and deployed configurations;

said second end assembly including an armrest configurable between raised extended and lowered retracted configurations;

said seating surface assembly configurable between a generally flat configuration and a generally arched configuration;

said backrest assembly including adjacent first and second backrest components, each of said first and second backrest components configurable between raised extended and lowered retracted configurations;

said seating apparatus being convertible between a bench-style seat configuration and a lounge-style configuration;

wherein in said bench-style configuration said first end assembly armrest is configured in the stowed configuration, said first and second backrest components are each configured in the raised extended configurations wherein each of said first and second backrest components form seat backrests, said second end assembly armrest is configured in the raised extended configuration wherein the top thereof is disposed to function as an armrest, and wherein said seating surface is configured in the generally flat configuration; and wherein in said lounge-style configuration said first end assembly armrest is configured in the deployed configuration and generally horizontally disposed, said first and second backrest components are each configured in the lowered retracted configurations wherein said first backrest component is disposed such that the top thereof functions as a lounge seat armrest, and wherein said second backrest component is substantially flush with said seating surface, said second end assembly armrest is configured in the lowered retracted configuration such that the top thereof is substantially flush with said seating surface, and said seating surface configured in the generally arched configuration.

6. A convertible boat seat according to claim 5, further including a speaker configurable between a stowed configuration wherein said speaker is generally recessed and a deployed configuration wherein said speaker projects from said boat seat.

7. A convertible boat seat according to claim 6, wherein said speaker is rotatable 360-degrees about a generally vertical axis when in said deployed configuration.

* * * * *